US012392233B2

(12) United States Patent
Annaiyappa

(10) Patent No.: US 12,392,233 B2
(45) **Date of Patent: *Aug. 19, 2025**

(54) METHODS AND APPARATUS FOR OPTIMIZING DOWNHOLE DRILLING CONDITIONS USING A SMART DOWNHOLE SYSTEM

(71) Applicant: Nabors Drilling Technologies USA, Inc., Houston, TX (US)

(72) Inventor: Pradeep Annaiyappa, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/739,508

(22) Filed: Jun. 11, 2024

(65) Prior Publication Data

US 2024/0328299 A1 Oct. 3, 2024

Related U.S. Application Data

(63) Continuation of application No. 17/554,176, filed on Dec. 17, 2021, now Pat. No. 12,031,424.

(51) Int. Cl.

| | |
|---|---|
| ***E21B 44/04*** | (2006.01) |
| ***E21B 7/04*** | (2006.01) |
| ***E21B 21/08*** | (2006.01) |
| ***E21B 44/00*** | (2006.01) |
| ***E21B 47/12*** | (2012.01) |

(52) U.S. Cl.

CPC ..... *E21B 44/04* (2013.01); *E21B 7/04* (2013.01); *E21B 21/08* (2013.01); *E21B 44/005* (2013.01); *E21B 47/12* (2013.01)

(58) Field of Classification Search

CPC ..... E21B 47/12; E21B 44/04; E21B 44/005; E21B 21/08; E21B 7/04

See application file for complete search history.

(56) References Cited

U.S. PATENT DOCUMENTS

| | | | | |
|---|---|---|---|---|
| 3,581,830 | A | 6/1971 | Stoner et al. | |
| 2020/0080409 | A1 * | 3/2020 | Haggerty | E21B 7/04 |

* cited by examiner

*Primary Examiner* — Tara Schimpf
*Assistant Examiner* — Lamia Quaim
(74) *Attorney, Agent, or Firm* — Haynes and Boone, LLP

(57) ABSTRACT

An apparatus and method of drilling a wellbore using a drill string, one or more controllers, and one or more sensors. The method includes drilling the wellbore using the drill string; and measuring, by the sensor(s), a parameter. The method also includes, using the controller(s) to: calculate an efficiency parameter based on the measured parameter; calculate a difference between the calculated efficiency parameter and a target efficiency parameter; and generate instructions to reduce the difference. The method also includes implementing, by a controller, instructions to reduce the difference between the measured efficiency parameter and the target efficiency parameter.

20 Claims, 4 Drawing Sheets

METHODS AND APPARATUS FOR OPTIMIZING DOWNHOLE DRILLING CONDITIONS USING A SMART DOWNHOLE SYSTEM

CROSS-REFERENCE TO RELATED APPLICATION

This application is a continuation of U.S. patent application Ser. No. 17/554,176, filed Dec. 17, 2021, the entire disclosure of which is hereby incorporated herein by reference.

BACKGROUND

At the outset of a drilling operation, drillers typically establish a drilling plan that includes a target location and a drilling path, or well plan, to the target location. Once drilling commences, the bottom hole assembly ("BHA") is directed or "steered" from a vertical drilling path in any number of directions, to follow the proposed well plan. For example, to recover an underground hydrocarbon deposit, a well plan might include a vertical section to a point above the reservoir, then a directional section and deviated or horizontal section that penetrates the deposit. The drilling operator may then steer the BHA, including the bit, through the vertical, directional, and horizontal aspects in accordance with the plan.

Conventionally, when a drilling operator provides instructions to the BHA and other drilling equipment, the drilling operator uses his or her past experiences and—in least in part—estimated downhole conditions to create drilling instructions. The conditions are estimated because not all parameters measured and/or calculated downhole are relayed to the surface in a timely manner. Instead, some downhole measurements are only accessible at the surface of the well when the downhole tool is brought to the surface and the measurements are then downloaded from the tool. When this is the case, these downhole conditions or measurements are estimated based on their relationship with more readily available measurements. Examples of estimated measurements include an estimated weight on the bit ("WOB"), an estimated torque on bit, and an estimated differential pressure. These estimated measurements, however, are not always correct. For example, the estimated WOB calculated at the surface may be incorrect due to higher-than-expected friction between the drill string and the wellbore, which results in a lower actual WOB. The use of incorrect estimated measurements in combination with the drilling operator's subjective response to the incorrect estimated measurement can lead to less-than-optimal drilling instructions and conditions. As a result, unplanned drilling events such as excessive vibration, bit whirl, and bit balling may occur.

SUMMARY

In some embodiments, the present disclosure includes a method of drilling a wellbore using a drill string and a smart downhole system that includes one or more downhole controllers and one or more downhole sensors, the method including: (a) storing, in the one or more downhole controllers, a target efficiency parameter; (b) drilling the wellbore using the drill string; (c) measuring, by one or more downhole sensors, a parameter; (d) calculating, by the one or more downhole controllers, an efficiency parameter based on the measured parameter; (c) calculating, by the one or more downhole controllers, a difference between the calculated efficiency parameter and the target efficiency parameter; (f) generating, by the one or more downhole controllers, first instructions to reduce the difference; (g) sending, from the one or more downhole controllers and to a surface controller, the first instructions; (h) generating, by the surface controller, second instructions based on the first instructions; and (i) implementing, by the surface controller, the second instructions to reduce the difference between the measured efficiency parameter and the target efficiency parameter. In some embodiments, the target efficiency parameter is minimum downhole vibration; and wherein the step (d) calculates downhole vibration. In some embodiments, the difference exceeding a threshold indicates that the calculated downhole vibration should be reduced; wherein the first instructions are associated with minimizing the downhole vibration; and wherein the second instructions reduce a feedoff rate to minimize the downhole vibration. In some embodiments, the method further includes: (j) sending, from the one or more downhole controllers and to the surface controller, the calculated downhole vibration. In some embodiments, the step (c) measures one or more of: a measured weight on bit; a measured torque on bit; and a measured differential pressure. In some embodiments, the step (h) is automatically implemented upon receipt of the first instructions by the surface controller. In some embodiments, the target efficiency parameter and the measured efficiency parameter are associated with bit whirl; and wherein implementing, by the surface controller, the second instructions reduce bit whirl. In some embodiments, the method also includes (k) connecting a first stand to the drill string during a first connection; and (l) connecting a second stand to the drill string during a second connection that is subsequent to the first connection; and (m) touching a bottom of the wellbore with the drill string after the second connection; wherein the steps (c)-(i) occur after the first connection and before touching the bottom of the wellbore with the drill string after the second connection. In some embodiments, the smart downhole system forms a portion of a rotary steerable system that is attached to the drill string. In some embodiments, a bottom hole assembly is attached to the drill string; and wherein the smart downhole system is attached to the drill string at a location that is spaced from the bottom hole assembly.

In some embodiments, the present disclosure includes an apparatus adapted to drill a wellbore including: a drill string; a surface control system that controls movement of the drill string; and a smart downhole system attached to the drill string; wherein the smart downhole system includes: one or more downhole controllers and one or more downhole sensors configured to measure a parameter; and wherein the one or more downhole controllers is configured to: (a) store a target efficiency parameter; (b) receive a measured parameter from the one or more downhole sensors; (c) calculate an efficiency parameter based on the measured parameter; (d) calculate a difference between the calculated efficiency parameter and the target efficiency parameter; (e) generate first instructions to reduce the difference; and (f) send, to the surface controller, the first instructions; and wherein the surface control system is configured to: (g) generate second instructions based on the first instructions; and (h) implement the second instructions to reduce the difference between the measured efficiency parameter and the target efficiency parameter. In one embodiment, the target efficiency parameter is minimum downhole vibration; and wherein the calculated efficiency parameter is a calculated downhole vibration. In one embodiment, the difference exceeding a threshold indicates that the calculated downhole vibration should be reduced; wherein the first instructions are associated with minimizing the downhole vibration; and wherein the second instructions reduce a feedoff rate to minimize the downhole vibration. In one embodiment, the one or more downhole controllers is further configured to: (i) send, to the surface controller, the calculated downhole vibration. In one embodiment, the measured parameter is one or more of: a measured weight on bit; a measured torque on bit; and a measured differential pressure. In one embodiment, the surface control system is configured to automatically generate the second instructions upon receipt of the first instructions. In one embodiment, the smart downhole system and the surface control system form a closed loop system for optimizing downhole drilling conditions. In one embodiment, the target efficiency parameter and the calculated efficiency parameter are associated with bit whirl; and wherein implementing, by the surface controller, the second instructions reduces bit whirl. In one embodiment, the smart downhole system forms a portion of a rotary steerable system that is attached to the drill string. In one embodiment, a bottom hole assembly is attached to the drill string; and wherein the smart downhole system is attached to the drill string at a location that is spaced from the bottom hole assembly.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
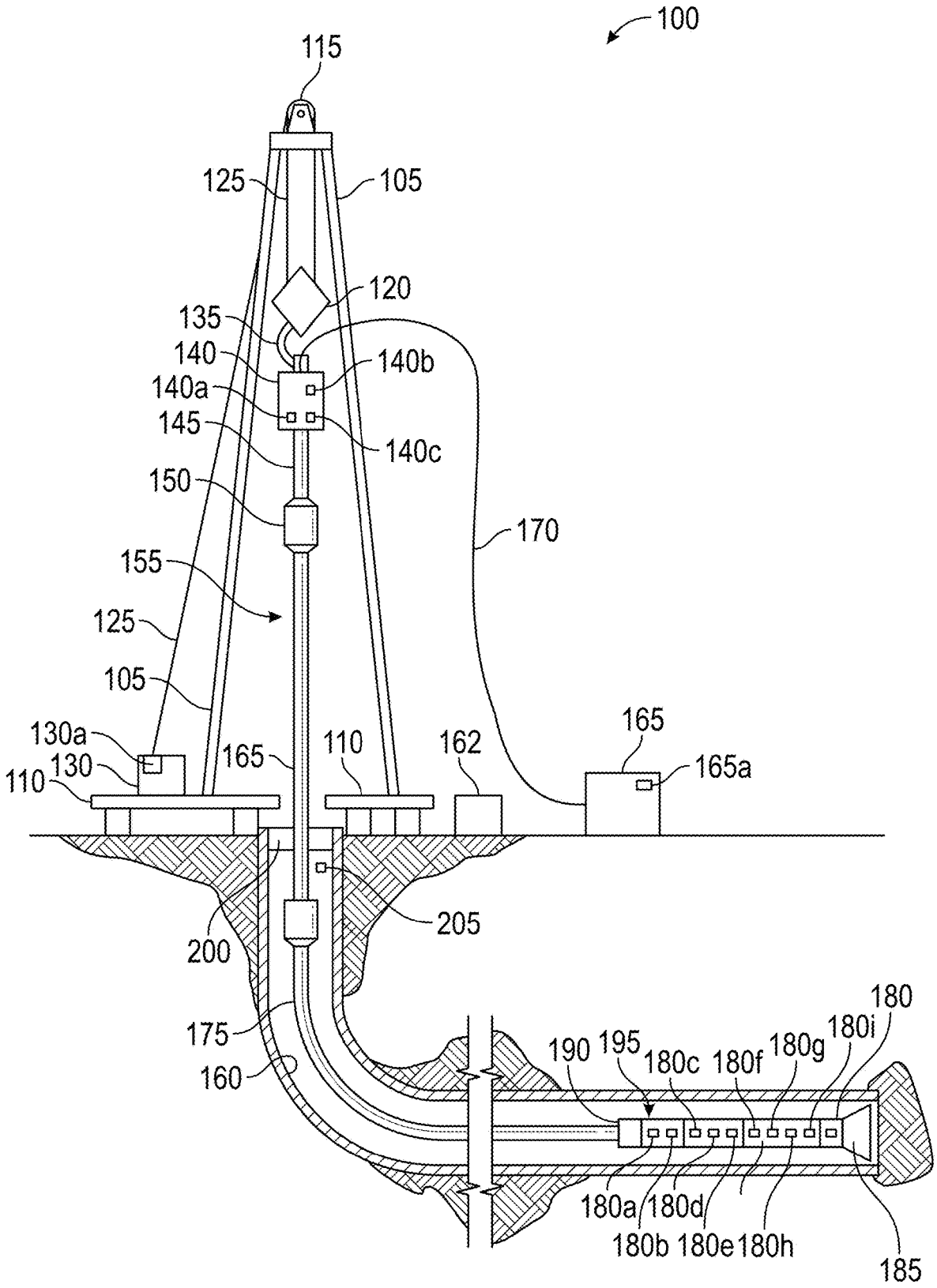
FIG. 1 is a schematic diagram of a drilling rig apparatus including a bottom hole assembly ("BHA"), according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and methods disclosed herein automate the control of a drilling operation, resulting in increased efficiency and speed compared to conventional systems that rely on estimated downhole measurements and require significantly more manual input or pauses to provide for input. Conventionally, and when a drilling operator controls/steers a drilling tool such as the BHA and other drilling equipment, the drilling operator draws on his or her past experiences and the performance of the well to determine the appropriate response to drilling events such as deviation from the actual well path and other unplanned drilling events such as excessive downhole vibration, undesirable bit whirl and bit balling, and the like. This is a very subjective process that is performed by the drilling operator and that is based on his or her judgment. In some instances, the creation of the instructions by the drilling operator is based on estimated downhole measurements that are not accurate. As a result, excessive vibration, bit balling, and bit whirl may occur. In some instances, drilling tools are damaged. The apparatus and methods disclosed herein provide more accurate and timely values for weight on bit, torque on bit, differential pressure, and/or vibration rate, thus allowing for optimization of drilling parameters in real time or near real time. In some embodiments, the apparatus and method may automate the creation, sending, and/or execution of the instructions. Specifically, the apparatus and method disclosed herein relate to a drilling system that includes a smart downhole system with a downhole controller and one or more sensors that monitor downhole drilling parameters. The downhole drilling parameters may include weight on bit, torque on bit, differential pressure, and/or downhole vibration. The smart downhole system calculates an efficiency parameter based on the measured parameters and calculates a difference between a stored target parameter and the calculated efficiency parameter. The downhole computing system or smart downhole system is programmed to generate instructions based on the difference and to send instructions to be implemented and/or considered by the surface control system. The way in which the downhole computing system and the surface control system can be combined to work together further automates portions of a drilling process while also using previously unavailable measured downhole parameters.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a control system to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A drive system 140 is suspended from the hook 135. A quill 145, extending from the drive system 140, is attached to a saver sub—150, which is attached to a drill string 155 suspended within a wellbore 160. Alternatively, the quill 145 may be attached to the drill string 155 directly. The term "quill" as used herein is not limited to a component which directly extends from the drive system 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill." In the example embodiment depicted in FIG. 1, the drive system 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may additionally or alternatively include a torque sensor 140*a* coupled to or otherwise associated with the drive system 140. The torque sensor 140*a* may be configured to detect a value or range of the torsion of the quill 145 and/or the drill string 155 (e.g., in response to operational forces acting on the drill string). The drive system 140 may additionally or alternatively include or otherwise be associated with a speed sensor 140*b* configured to detect a value or range of the rotational speed of the quill 145. The drive system 140, the draw works 130, the crown block 115, the traveling block 120, drilling line or deadline anchor may additionally or alternatively include or otherwise be associated with a weight-on-bit ("WOB") or hook load sensor 140*c* (e.g., one or more sensors installed somewhere in the load path mechanisms to detect and calculate WOB, which can vary from rig-to-rig). The WOB sensor 140*c* may be configured to detect a WOB value or range, where such detection may be performed at the drive system 140, the draw works 130, or other component of the apparatus 100. Generally, the hook load sensor 140*c* detects the load on the hook 135 as it suspends the drive system 140 and the drill string 155. The apparatus 100 may also include a surface control system 162 that is operably coupled to the drive system 140, the draw works 130, and one or more pumps of a mud pump system 165, which delivers drilling fluid to the drill string 155 through a hose or other conduit 170.

In some embodiments, a mud pump sensor 165*a* monitors the output of the mud pump system 165 and may measure the flow rate produced by the mud pump system 165 and/or a pressure produced by the mud pump system 165.

The drill string 155 includes interconnected sections of drill pipe 175 and a BHA 180—which includes a drill bit 185—is attached to the drill string 155.

The BHA 180 may include a variety of downhole tools and sensors. For example, the BHA 180 may include a downhole annular pressure sensor 180*a*. The downhole annular pressure sensor 180*a* may be configured to detect a pressure value or range in the annulus-shaped region defined between the external surface of the BHA 180 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on).

The BHA 180 may also include a shock/vibration sensor 180*b* that is configured for detecting shock and/or vibration. The BHA 180 may also include delta pressure (ΔP) sensor(s) 180*c* that are configured to detect a pressure differential between outside and inside of the BHA 180 or before and after the drill bit 185. The BHA 180 may also include one or more torque sensors 180*d*, such as a bit torque sensor, that measures the torque applied to the bit 185 or at a location along the BHA 180. The one or more torque sensors 180*d* may alternatively be located along the drill string 155 to detect a value or range of the torsion of the drill string 155.

The BHA 180 may also include a toolface sensor 180*e* configured to estimate or detect the current toolface orientation or toolface angle. The toolface sensor 180*e* may be or include a conventional or future-developed gravity toolface sensor which detects toolface orientation relative to the Earth's gravitational field. Alternatively, or additionally, the toolface sensor 180*e* may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor 180*e* may also, or alternatively, be or include a conventional or future-developed gyro sensor. The apparatus 100 may additionally or alternatively include a WOB sensor 180*f* integral to the BHA 180 and configured to detect WOB at or near the BHA 180. The BHA 180 may also include an inclination sensor 180*g* configured to detect inclination at or near the BHA 180. The BHA 180 may also include an azimuth sensor 180*h* configured to detect azimuth at or near the BHA 180. In some embodiments, the BHA 180 also includes another directional sensor 180*i* (e.g., azimuth, inclination, toolface, combination thereof, etc.) that is spaced along the BHA 180 from one or another directional sensor (e.g., the inclination sensor 180*g*, the azimuth sensor 180*h*). The sensors 180*a*-180*i* are not limited to the arrangement illustrated in FIG. 1 and may be spaced along the BHA 180 in a variety of configurations.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

The BHA 180 may include one or more measurement-while-drilling ("MWD") or wireline conveyed instruments, flexible connections, a rotary steerable system ("RSS") or a mud motor, stabilizers, and/or drill collars, among other components. The downhole MWD may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to other downhole tools, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 180 may have the ability to store measurements for later retrieval via wireline and/or when the BHA 180 is tripped out of the wellbore 160.

In some embodiments, the BHA 180 also includes a downhole controller 190 that is operably coupled to any one or more of the sensors 180*a*-180*i*, the MWD tools, and other components of the BHA 180 itself. In some embodiments, the downhole controller 190 comprises one or more downhole controllers. Generally, the downhole controller 190 is configured to calculate efficiency parameters from parameters obtained from the sensors of the BHA 180, including those in the MWD tools; transmit the calculated efficiency measurements and/or parameters obtained from the sensors of the BHA 180 to the surface control system 162; control/instruct components of the BHA 180; and/or transmit operational control signals or other feedback to the surface control system 162 via wired or wireless transmission means which, for the sake of clarity, are not depicted in FIG. 1. Generally, the controller 190 and the sensors in the BHA 180 (e.g., the sensors 180*a*-180*i* and the sensors in the MWD tools) form a smart downhole system 195.

The smart downhole system 195 is configured to control or assist in the control of one or more components of the apparatus 100 based on measured/calculated downhole conditions. For example, the smart downhole system 195 may be configured to transmit operational control signals or instructions to the surface control system 162, the draw works 130, the drive system 140, other components of the BHA 180, and/or the mud pump system 165 in response to data obtained by downhole sensors. In one embodiment, the controller 190 of the smart downhole system 195 receives data from the MWD tools, any one or more of the sensors 180*a*-180*i*, data from the surface control system 162, etc.

In an example embodiment, the apparatus 100 may also include a rotating blow-out preventer ("BOP") 200, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 200. The apparatus 100 may also include a surface casing annular pressure sensor 205 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

Generally, the surface control system 162 and the smart downhole system 195: monitor, in real-time, tool settings and drilling operations relating to a wellbore; create and/or modify drilling instructions based on the monitored drilling operations; monitor the responsiveness of drilling equipment used in the drilling operation; and identify potential problems with the drilling operations. As used herein, the term "real-time" is meant to encompass close to real-time, such as within about 10 seconds, preferably within about 5 seconds, and more preferably within about 2 seconds. Near real time includes the amount of time between connections of consecutive stands or the amount of time between a first stand being connected and the drill string 155 touching bottom after a second, consecutive stand has been connected.

Figure 2:
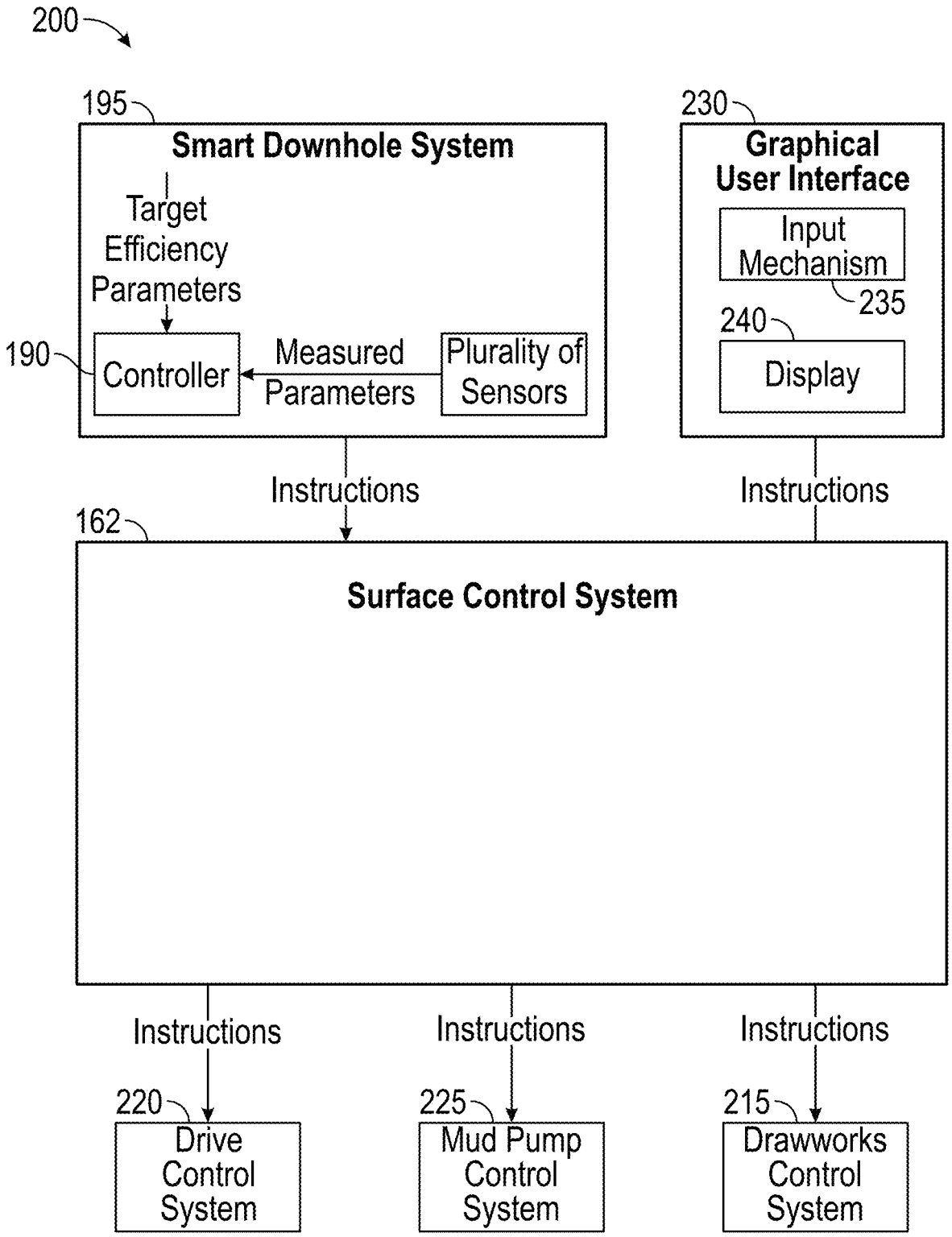
FIG. 2 is a data flow related to a portion of the drilling rig apparatus of FIG. 1, according to one or more aspects of the present disclosure.

FIG. 2 is a diagrammatic illustration of a data flow 210 involving at least a portion of the apparatus 100 according to one embodiment. Generally, the surface control system 162 is configured to control or assist in the control of one or more components of the apparatus 100. For example, the surface control system 162 may be configured to transmit operational control signals to the draw works 130 via a draw works control system 215, the drive system 140 via a drive control system 220, the mud pump system 165 via a mud pump control system 225, and/or the BHA 180. The surface control system 162 may be a stand-alone component installed near the mast 105 and/or other components of the apparatus 100. In an example embodiment, the surface control system 162 includes one or more systems located in a control room proximate the mast 105, such as the general-purpose shelter often referred to as the "doghouse" serving as a combination tool shed, office, communications center, and general meeting place. The surface control system 162 may be configured to transmit the operational control signals to the drive control system 220, the draw works control system 215, the mud pump control system 225, and/or the BHA 180 via wired or wireless transmission means. In some embodiments the drive control system 220 includes the torque sensor 140*a*, the quill position sensor, the hook load sensor 140*c*, the pump pressure sensor, the MSE sensor, and the rotary RPM sensor, and/or other means for controlling the rotational position, speed and direction of the quill or other drill string component coupled to the drive system (such as the quill 145 shown in FIG. 1). The drive control system 220 is configured to receive a drive control signal, which directs the position (e.g., azimuth), spin direction, spin rate, and/or oscillation of the quill 145. The drive control system 220 is not required to include a top drive, but instead may include other drive systems, such as a power swivel, a rotary table, a coiled tubing unit, a downhole motor, and/or a conventional rotary rig, among others. In some embodiments, the mud pump control system 225 includes a mud pump surface control system and/or other means for controlling the flow rate and/or pressure of the output of the mud pump system 165 and any associated sensors, such as the mud pump sensor 165*a*, for monitoring the output of the mud pump system 165. In some embodiments, the draw works control system 215 includes the draw works surface control system and/or other means for controlling the feed-out and/or feed-in of the drilling line 125. Such control may include rotational control of the draw works (in v. out) to control the height or position of the hook 135 and may also include control of the rate the hook 135 ascends or descends.

Generally, the surface control system 162 is operably coupled to or includes a graphical user interface ("GUI") 230. The GUI 230 includes an input mechanism 235 for user-inputs or drilling parameters. The input mechanism 235 may include a touch-screen, keypad, voice-recognition apparatus, dial, button, switch, slide selector, toggle, joystick, mouse, data base and/or other conventional or future-developed data input device. Such input mechanism 235 may support data input from local and/or remote locations. Alternatively, or additionally, the input mechanism 235 may include means for user-selection of input parameters, user-selection of target settings, selecting to implement the selected instruction combination, and/or selecting a type of tool that forms a portion of the BHA 180, such as via one or more drop-down menus, input windows, etc. In general, the input mechanism 235 and/or other components within the scope of the present disclosure support operation and/or monitoring from stations on the rig site, as well as, one or more remote locations with a communications link to the system, network, local area network ("LAN"), wide area network ("WAN"), Internet, satellite-link, and/or radio, among other means. The GUI 235 may also include a display 240 for visually presenting information to the driller in textual, graphic, or video form. The display 240 may also be utilized by the driller to input the input parameters in conjunction with the input mechanism 235. For example, the input mechanism 235 may be integral to or otherwise communicably coupled with the display 240. Depending on the implementation, the display 240 may include, for example, an LED or LCD display computer monitor, touch-screen display, television display, a projector, or other display device. The GUI 230 and the surface control system 162 may be discrete components that are interconnected via wired or wireless means. Alternatively, and in some embodiments, the GUI 230 is an integral component of the surface control system 162.

In some embodiments and as illustrated in FIG. 2, the smart downhole system 195 is configured to measure parameters using the plurality of sensors (e.g., the sensors 180*a*-180*i* and other downhole sensors) and receive and/or generate target efficiency parameters. In some embodiments, the downhole controller 190 calculates an efficiency parameter using, or based on, the measured parameters. The target efficiency parameters may be received by the smart downhole system 195 before the smart downhole system 195 is positioned downhole or may be sent from the surface control system 162 to the smart downhole system 195 when the smart downhole system 195 is downhole. In some embodiments, the smart downhole system 195 generates the target efficiency parameters based on measured downhole conditions, a well plan, and/or other drilling instructions sent from the surface control system 162.

Generally, a target efficiency parameter is or relates to an ideal or desired downhole condition or measurement and may be expressed as a minimum value, a maximum value, an acceptable range of values, or merely the minimization or maximation of a value. One example of a target efficiency parameter relates to reducing downhole vibration. In one embodiment, the target efficiency parameter may be a threshold value for downhole vibration that should not be exceeded. In another embodiment, the target efficiency parameter is the minimization of downhole vibration. Downhole vibration may be caused by touching bottom too fast or touching bottom too fast in combination with other downhole conditions that are created by the surface control system 162. The surface control system, with conventional systems, does not receive data relating to these downhole conditions in real time or near real time, and therefore, cannot optimize instructions at the surface to reduce or eliminate downhole vibration. For example, the feedoff rate may be used to estimate an incorrect speed at which the BHA 180 is touching bottom, with the incorrect speed resulting in downhole vibration. Without knowing the values for the measured downhole vibration, a conventional surface control system has no indication that the feedoff rate should be reduced to mitigate downhole vibration. The smart downhole system 195, however, can compare the target vibration value with a calculated vibration value to determine if/when downhole vibration exceeds the target value. When the downhole vibration exceeds the target value, the smart downhole system 195 may determine that the feedoff rate should be reduced in order to reduce downhole vibration. In some embodiments, the smart downhole system 195 then generates instructions to reduce the difference between the target and calculated efficiency parameter. In this example, the instructions generally relate to reducing the speed at which the drill string 155 is lowered. In some embodiments, the instructions sent from the smart downhole system 195 may include generic instructions such as "reduce feedoff rate." In some embodiments, the calculated efficiency parameters or measured parameters are sent from the smart downhole system 195 to the surface control system 162.

Figure 3:
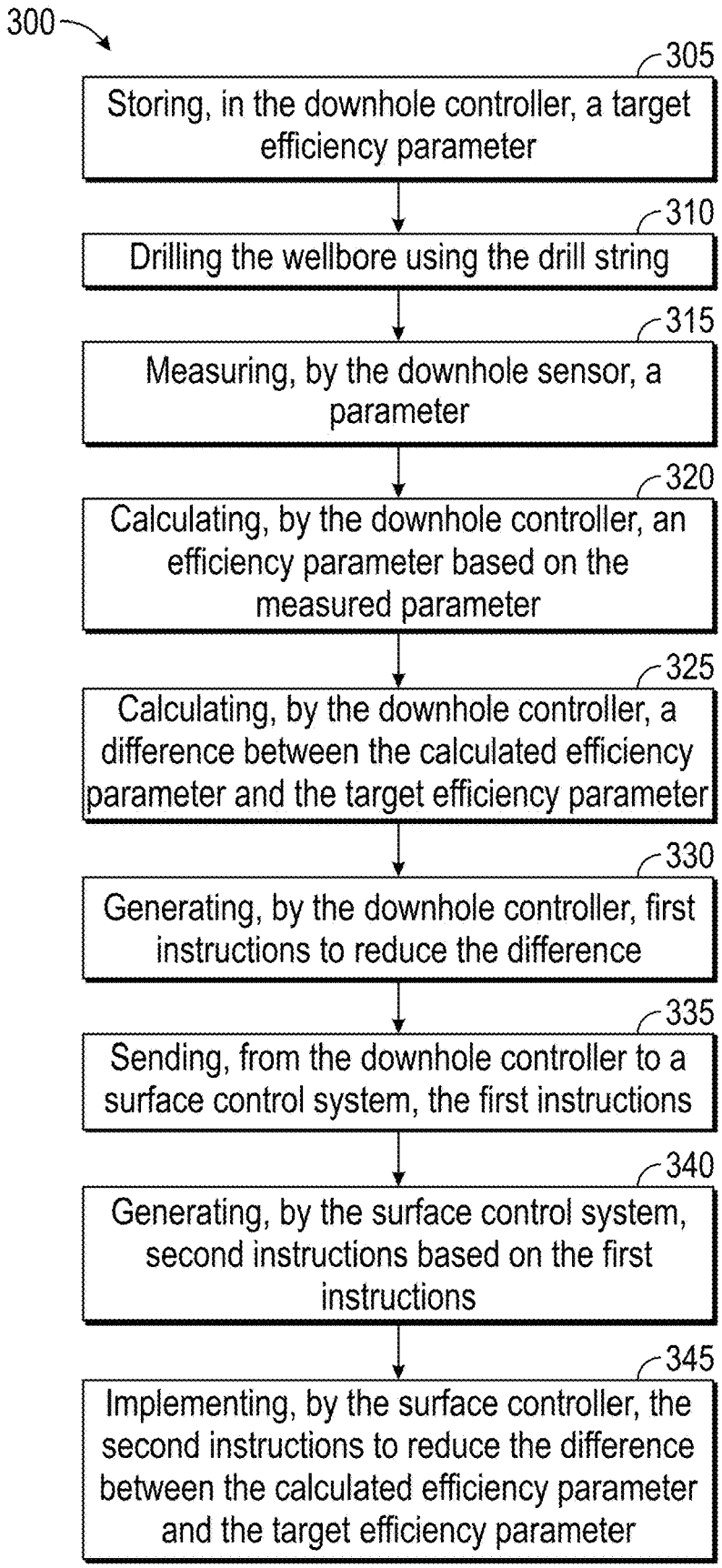
FIG. 3 is a flow-chart diagram of a method of using the drilling rig apparatus of FIG. 1, according to one or more aspects of the present disclosure.

In an example embodiment, as illustrated in FIG. 3 with continuing reference to FIG. 1-2, a method 300 of operating the apparatus 100 includes storing, in the downhole controller 190, a target efficiency parameter at step 305; drilling the wellbore 160 using the drill string 155 at step 310; measuring, by one or more downhole sensors, a parameter at step 315; calculating, by the downhole controller 190, an efficiency parameter based on the measured parameter at step 320; calculating, by the downhole controller 190, a difference between the calculated efficiency parameter and the target efficiency parameter at step 325; generating, by the downhole controller, first instructions to reduce the difference at step 330; sending, from the downhole controller 190 and to the surface control system 162, the first instructions at step 335; generating, by the surface control system 162, second instructions based on the first instructions at step 340; and implementing, by the surface control system 162, the second instructions to reduce the difference between the measured efficiency parameter and the target efficiency parameter at step 345.

In some embodiments and at the step 305, the downhole controller 190 stores the target efficiency parameter. As noted above, the storing of the target efficiency parameter may occur while the controller 190 is not downhole or may be sent to the controller 190 when the controller 190 is downhole. In some embodiments, the smart downhole system 195 receives the target efficiency parameter from the surface control system 162 via a wired or a wireless connection or via any other means. In other embodiments, the smart downhole system 195 generates the target efficiency parameter before storing the target efficiency parameter.

In some embodiments and at the step 310, the wellbore 160 is drilled using the BHA 180.

In some embodiments and at the step 315, one or more downhole sensors measures a parameter. As noted above, in some embodiments, the parameter relates to downhole vibration. In other embodiments, the parameter relates to bit balling and the prevention of bit balling, and therefore, is a measurement related to bit whirl. In some embodiments, the sensor may be or include: a sensor measuring actual weight on bit, such as the WOB sensor 180*f*; a sensor measuring an actual differential pressure, such as the delta pressure ($\Delta P$) sensor(s) 180*c*; a sensor measuring an actual torque on bit, such as the torque sensors 180*d*; a sensor measuring downhole vibration, such as the shock/vibration sensor 180*b*. The sensor may detect an unplanned, dynamic drilling event related to vibration and sends those measurements to the controller 190.

In some embodiments and at the step 320, the downhole controller 190 calculates an efficiency parameter based on the measured parameter. In some embodiments, the efficiency parameter is downhole vibration and the downhole controller 190 calculates for the downhole vibration rate based on the measured parameters. In some embodiments, information from the surface control system 162 is sent to the smart downhole system 195 to enable the smart downhole system 195 to calculate the efficiency parameter. For example, depth information may be sent to the smart downhole system 195. In some embodiments, the efficiency parameter indicates the potential or existence of bit whirl and/or bit balling.

In some embodiments and at the step 325, the downhole controller 190 calculates the difference between the stored efficiency parameter and that of the calculated efficiency parameter. In some embodiments, if the difference is below a certain threshold, then the method 300 returns to step 315. In some embodiments, if the difference is above a certain threshold, then the method 300 proceeds to the step 330.

In some embodiments and at the step 330, the downhole controller creates first instructions to reduce the difference between the target efficiency parameter and the calculated efficiency parameter. In some embodiments, the first instructions are to change a drilling parameter that is controlled by the surface control system 162. For example, the change could be a reduction or increase to a drilling parameter that is controlled by the surface control system 162. The drilling parameter that is controlled by the surface control system 162 may be the feedoff rate, for example. As such, the first instruction may include "reduce the feedoff rate." In some embodiments, the first instructions include the measured parameter and/or calculated efficiency parameter, such as the calculated downhole vibration. In some embodiments, the first instructions relate to changing the feedoff rate, WOB, or downhole torque.

In some embodiments and at the step 335, the downhole controller 190 sends the generated first instructions to the surface control system 162. In some embodiments, the first instructions are sent via wired or wireless transmission means. In some embodiments, the actual downhole weight on bit, actual torque on bit, and/or actual differential pressure measurements are sent to the surface control system 162.

In some embodiments and at the step 340, the surface control system 162 generates second instructions based on the first instructions. For example, and when the first instructions are to reduce the feedoff rate, the surface control system 162 generates specific instructions as to how much the feedoff rate should be reduced and those specific instructions are the second instructions. For example, and when the first instructions are to "reduce the feedoff rate," the second instructions can include instructions with a numerical value of a target feedoff rate. In some embodiments, the second instructions are the same as the first instructions. In other embodiments, however, the surface control system 162 uses the first instructions, along with other drilling parameters, to create the second instructions. For example, when the first instructions are to reduce the feedoff rate, the surface control system 162 determines the existing or historical feedoff rate in order to calculate a new, target feedoff rate that is lower than the previous feedoff rate. In some embodiments, the second instructions are automatically generated upon receipt of the first instructions.

In some embodiments and at the step 345, the second instructions are implemented by the surface control system 162. The second instructions may control the surface systems in an effort to reduce the difference between the calculated efficiency parameter and the target efficiency parameter. The second instructions may be displayed on the GUI 230, and the driller may select to approve the second instructions. In some embodiments, the second instructions are automatically executed by the surface control system 162. In other embodiments, the driller may add additional data at the surface to alter the second instructions before the surface control system 162 implements the second instructions. In some embodiments, the driller is required to review and/or approve one or more steps of method 300.

In some embodiments, the steps 315, 320, 325, 330, 335, 340, and 345 occur after a first stand is added to the drill string 155 and before the drill string 155 touches bottom after a second subsequent stand is added to the drill string 155. In some embodiments, the steps 315, 320, 325, 330, 335, 340, and 345 occurs after the first stand is added but before a third stand, which is subsequent to the second stand, is added to the drill string 155. For example, when the drill string 155 touches down after a first connection, and when there is enough vibration for the smart downhole system 195 to generate and send instructions up to the surface control system 162, the generation of the first and second instructions occurs before a subsequent touching down of the drill string 155. In some embodiments, the sending of the instructions to the surface control system 162 may occur any time before the BHA 180 is lowered down to touch bottom for the next connection. In some embodiments, this optimization of downhole drilling conditions is based on measured downhole conditions and occurs between a first connection and touching down after adding a second connection. In some embodiments and as noted above, the optimization of downhole drilling conditions occurs between a first and third connection. This is an improvement to conventional systems, which require the BHA 180 to be tripped out before the measured downhole conditions can be accessed.

In some embodiments, the calculated efficiency parameter and/or the measured parameters are sent from the smart downhole system 195 to the surface control system 162 in addition to the first instructions so that surface control system 162 can be calibrated or trained in response to drilling conditions.

In one or more embodiments, the target efficiency parameter may be updated while drilling and sent to the smart downhole system 195.

In some embodiments, the method 300 also includes sending the calculated downhole vibration measurement and/or measured parameters before, contemporaneously, or after step 335.

The smart downhole system 195 and the method 300 may be altered in a variety of ways. In some embodiments, and when the BHA 180 includes an RSS, the well plan is stored in the downhole controller 190 and the downhole controller 190 compares the location of the BHA 180 with the target well path to create instructions that alter the direction of the RSS so that the RSS is steered by the downhole controller 190. As such, the downhole controller 190 and the RSS form a downhole control loop. That is, a first closed-loop control system is formed in which the input is the target inclination angle and a second closed-loop control system in which the input is the target azimuth angle. Thus, in some embodiments, any individual aspect (or combination thereof) of steering, turning left and right, or changing the inclination is set up in a closed loop mode. In some embodiments and when set in closed loop mode, the azimuth is set as a target and the RSS will continuously target the azimuth using a closed loop with a regulator, for example a PID regulator (Proportional Integral Derivative) or logic rules, to steer and to maintain a heading. If it is pushed "off course" for any reason, the apparatus 100 will try to steer back. In closed loop inclination control, the inclination target will be set and then the RSS will steer towards the target using a build up rate that can be varied to suit the plan. Typically, the build up rate and turn rate setting can be estimated, based on the known performance of the system, but the actual build rate and turn rate will depend on the geology and drilling parameters and therefore may need adjusting from time to time.

In addition to the steering of the RSS and in some embodiments, the downhole controller 190 creates a third downhole control loop with the surface equipment by sending instructions to the surface control system 162 so that the surface control system 162 alters drilling parameters at the surface to affect or optimize the downhole conditions. Thus, the downhole controller 190 steers the RSS in response to downhole location measurements and also optimizes downhole drilling conditions by sending instructions to the surface control system 162. The use of the smart downhole system 195 allows for drilling instructions to be based on actual downhole conditions and optimized using a closed loop system, instead of being based on estimated conditions. As shock, vibration, whirl, stick-slip and other impacts will affect the BHA 180 in various ways and may cause critical parts of the BHA 180 to fail and hole quality to deteriorate, identification and correction of these conditions in real time or near real time is ideal.

While the smart downhole system 195 is described above as being associated with the BHA 180 or forming a portion of the BHA 180, in some embodiments the smart downhole system 195 is spaced along the drill string 155 and apart from the BHA 180. For example, a smart downhole system 195 may be located "uphole" from the BHA by over 100 joints or by at least 5% of the drill string 155 length so that the local conditions for that smart downhole system 195 are monitored. When the smart downhole system 195 is spaced from the BHA 180, a closed loop system is created between the smart downhole system 195 and the surface control system 162. The apparatus 100 may include one smart downhole system 195 that is spaced from the BHA 180 or multiple smart downhole systems—with one being located at the BHA 180 and one spaced from the BHA 180. When there are multiple smart downhole systems 195, the smart downhole systems 195 may be in communication downhole to prioritize/consolidate instructions being sent to the surface control system 162. However, in some embodiments the multiple smart downhole systems 195 send separate instructions, and the surface control system 162 receives both sets of instructions and prioritizes one set of instructions depending on the local drilling conditions experienced at each smart downhole system 195.

In some embodiments, using the method 300 and/or the apparatus 100, the smart downhole system 195 quickly generates drilling instructions based on the relationship between stored instructions and/or parameters and the results of those instructions and/or parameters. Thus, drilling conditions are optimized and the actual well path more closely aligns with the target well path, the speed at which drilling along the target well path improves, and/or the downhole tools experience less damages and wear therefore resulting in fewer trips out and reduced overall drilling time. In some embodiments, the method 300 and apparatus 100 produce more accurate data by calculating and acting upon, in near real time, the actual weight on bit, actual differential pressure, and actual torque on bit. In some embodiments, the first instructions being sent from the smart downhole system 195 and the automatic generation of the second instructions allow for drilling instructions to be implemented sooner than with conventional systems. In some embodiments, mitigating downhole vibration during a drilling event allows for a better method of drilling. In some embodiments, the apparatus 100 mitigates vibration in near real time.

Moreover, shock, vibration, whirl, and other impacts will affect the BHA 180 in various ways. It may cause critical parts of the BHA 180, sensors, tools, mechanical assemblies, to fail, parts to break, drill-bits to fail, hole quality to deteriorate and if these conditions can be identified in real time or near real time, then corrective action can be taken. Thus, using the method 300 and/or the apparatus 100, high vibration drilling events, improper feedoff rates, excessive bit whirl, and bit balling are quickly identified and resolved, which reduces the likelihood or frequency of equipment failure and/or well control issues.

Methods within the scope of the present disclosure may be local or remote in nature. These methods, and any controllers discussed herein, may be achieved by one or more intelligent adaptive controllers, programmable logic controllers, artificial neural networks, and/or other adaptive and/or "learning" controllers or processing apparatus. For example, such methods may be deployed or performed via PLC, PAC, PC, one or more servers, desktops, handhelds, and/or any other form or type of computing device with appropriate capability.

The term "about," as used herein, should generally be understood to refer to both numbers in a range of numerals. For example, "about 1 to 2" should be understood as "about 1 to about 2." Moreover, all numerical ranges herein should be understood to include each whole integer, or 1/10 Of an integer, within the range.

Figure 4:
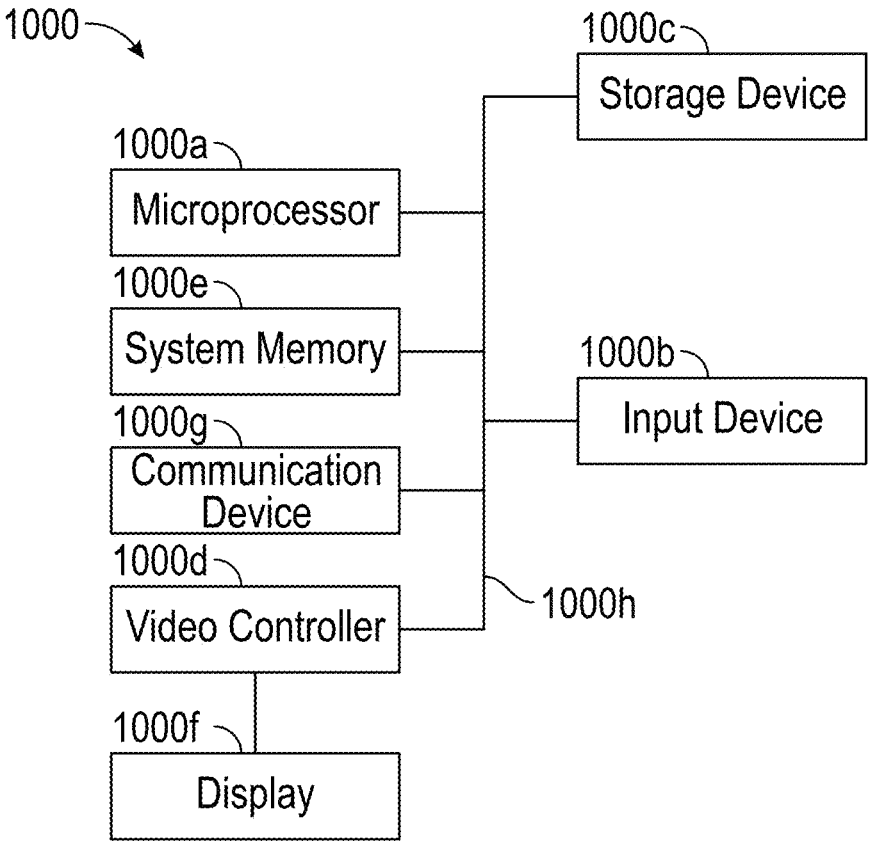
FIG. 4 is a diagrammatic illustration of a node for implementing one or more example embodiments of the present disclosure, according to one or more aspects of the present disclosure.

In an example embodiment, as illustrated in FIG. 4 with continuing reference to FIGS. 1-3, an illustrative node 1000 for implementing one or more embodiments of one or more of the above-described networks, elements, methods and/or steps, and/or any combination thereof, is depicted. The node 1000 includes a microprocessor 1000*a*, an input device 1000*b*, a storage device 1000*c*, a video controller 1000*d*, a system memory 1000*c*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable non-transitory medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, tablets, and cell phones.

In several example embodiments, one or more of the surface control system 162, the smart downhole system 195, the GUI 235, and any of the sensors, includes the node 1000 and/or components thereof, and/or one or more nodes that are substantially similar to the node 1000 and/or components thereof.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, a database may be any standard or proprietary database software, such as Oracle, Microsoft Access, SyBase, or DBase II, for example. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several example embodiments, one or more of the operational steps in each embodiment may be omitted or rearranged. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method of drilling a wellbore using a drill string, one or more controllers, and one or more sensors, the one or more controllers including a drilling controller adapted to control movement of the drill string, which method comprises:

connecting a first stand to the drill string during a first connection;

drilling the wellbore using the drilling controller to control movement of the drill string;

measuring, by the one or more sensors, a parameter;

determining, by at least one of the one or more controllers:

an efficiency parameter based on the measured parameter;

a difference between the determined efficiency parameter and a target efficiency parameter;

instructions to reduce the difference between the determined efficiency parameter and the target efficiency parameter, at least a first portion of which instructions are implementable by the drilling controller;

connecting a second stand to the drill string during a second connection that is subsequent to the first connection;

touching a bottom of the wellbore with the drill string after the second connection; and implementing, by the drilling controller, the at least a first portion of the instructions to reduce the difference between the determined efficiency parameter and the target efficiency parameter.

2. The method of claim 1, wherein:

the measured parameter includes a measured downhole vibration;

the target efficiency parameter includes a target downhole vibration; and the difference exceeding a threshold indicates that the measured downhole vibration should be reduced.

3. The method of claim 1, wherein the parameter measured by the one or more sensors includes one or more of:

a measured weight on bit;

a measured torque on bit;

a measured differential pressure.

4. The method of claim 1, wherein:

the target efficiency parameter and the determined efficiency parameter are associated with bit whirl; and implementing, by the drilling controller, the at least a first portion of the instructions reduces bit whirl.

5. The method of claim 1, wherein the at least one of the one or more controllers comprises one or more downhole controllers.

6. The method of claim 5, wherein the one or more downhole controllers form part of a rotary steerable system attached to the drill string.

7. The method of claim 5, wherein:

a bottom hole assembly is attached to the drill string; and the one or more downhole controllers are attached to the drill string at a location that is spaced apart from the bottom hole assembly.

8. The method of claim 5, wherein the drilling controller comprises a surface controller.

9. The method of claim 8, which further comprises:

sending, from the one or more downhole controllers to the surface controller, at least a second portion of the instructions.

10. The method of claim 9, which further comprises:

determining, by the surface controller, the at least a first portion of the instructions based on the at least a second portion of the instructions.

11. An apparatus adapted to drill a wellbore, the apparatus comprising:

a drill string;

one or more controllers, including a drilling controller, wherein the drilling controller is adapted to control movement of the drill string to drill the wellbore after a first stand is connected to the drill string via a first connection;

and one or more sensors, wherein the one or more sensors are adapted to measure a parameter while the drilling controller controls movement of the drill string to drill the wellbore;

wherein at least one of the one or more controllers is adapted to determine:

an efficiency parameter based on the measured parameter;

a difference between the determined efficiency parameter and a target efficiency parameter; and instructions to reduce the difference between the determined efficiency parameter and the target efficiency parameter, at least a first portion of which instructions are implementable by the drilling controller;

and wherein the drilling controller is further adapted to implement the at least a first portion of the instructions, to reduce the difference between the determined efficiency parameter and the target efficiency parameter, after a bottom of the wellbore is touched with the drill string following connection of a second stand to the drill string via a second connection that is subsequent to the first connection.

12. The apparatus of claim 11, wherein:

the parameter adapted to be measured by the one or more sensors includes a measured downhole vibration;

the target efficiency parameter includes a target downhole vibration; and the difference exceeding a threshold indicates that the measured downhole vibration should be reduced.

13. The apparatus of claim 11, wherein the parameter adapted to be measured by the one or more sensors includes one or more of:

a measured weight on bit;

a measured torque on bit;

a measured differential pressure.

14. The apparatus of claim 11, wherein:

the target efficiency parameter and the determined efficiency parameter are associated with bit whirl; and the at least a first portion of the instructions adapted to be implemented by the drilling controller reduce bit whirl.

15. The apparatus of claim 11, wherein the at least one of the one or more controllers comprises one or more downhole controllers.

16. The apparatus of claim 15, wherein the one or more downhole controllers form part of a rotary steerable apparatus attached to the drill string.

17. The apparatus of claim 15, further comprising a bottom hole assembly attached to the drill string;

wherein the one or more downhole controllers are attached to the drill string at a location that is spaced apart from the bottom hole assembly.

18. The apparatus of claim 15, wherein the drilling controller comprises a surface controller.

19. The apparatus of claim 18, wherein the one or more downhole controllers are adapted to send at least a second portion of the instructions to the surface controller.

20. The apparatus of claim 19, wherein the surface controller is adapted to determine the at least a first portion of the instructions based on the at least a second portion of the instructions.

* * * * *